US006851519B2

(12) United States Patent
Ach et al.

(10) Patent No.: US 6,851,519 B2
(45) Date of Patent: Feb. 8, 2005

(54) ELEVATOR WITH DRIVE UNIT MOUNTED IN A SUPERIOR LATERAL SECTION OF THE ELEVATOR HOISTWAY

(75) Inventors: Ernst Ach, Ebikon (CH); Donato Carparelli, Pregassona (CH); Guntram Begle, Küssnacht am Rigi (CH)

(73) Assignee: Inventio AG, Hergiswil (CH)

( * ) Notice: Subject to any disclaimer, the term of this patent is extended or adjusted under 35 U.S.C. 154(b) by 87 days.

(21) Appl. No.: 10/397,544

(22) Filed: Mar. 26, 2003

(65) Prior Publication Data

US 2003/0159891 A1 Aug. 28, 2003

Related U.S. Application Data

(63) Continuation of application No. PCT/CH01/00554, filed on Sep. 14, 2001.

(51) Int. Cl.[7] ..... B66B 7/06
(52) U.S. Cl. ..... 187/266; 187/254; 187/264
(58) Field of Search ..... 187/251, 254, 187/264, 266

(56) References Cited

U.S. PATENT DOCUMENTS 6,247,557 B1 * 6/2001 Kobayashi et al. ..... 187/266
6,471,012 B2 * 10/2002 Faletto ..... 187/266
6,598,707 B2 * 7/2003 Nakagaki et al. ..... 187/254
6,655,500 B2 * 12/2003 Orrman et al. ..... 187/254

FOREIGN PATENT DOCUMENTS

| | | |
|---|---|---|
| DE | 38 02 386 | 8/1988 |
| DE | 198 22 909 | 11/1999 |
| EP | 0 970 912 | 1/2000 |
| JP | 4 50297 | 11/1992 |
| WO | WO 00/44664 | 8/2000 |

* cited by examiner

*Primary Examiner*—Eileen D. Lillis
*Assistant Examiner*—Thuy V. Tran
(74) *Attorney, Agent, or Firm*—MacMillan, Sobanski & Todd, LLC

(57) ABSTRACT

An elevator the drive unit is arranged laterally in a top section of an elevator shaft and, as seen from a shaft door opening, at a side wall of the elevator shaft. At least one cable is guided over deflecting rollers of a support frame of the elevator car and over deflecting rollers of the counterweight and serves as a support and drive cable for the elevator car or the counterweight. The cable is guided over a drive pulley of the drive unit and is arranged transversely to the side wall. The support frame is constructed as a rucksack frame with an upright frame guided by guide rails and a horizontal base frame on which the elevator car is arranged. On travel to the uppermost stopping point, the upper part of the elevator car travels past the drive unit.

15 Claims, 4 Drawing Sheets

ELEVATOR WITH DRIVE UNIT MOUNTED IN A SUPERIOR LATERAL SECTION OF THE ELEVATOR HOISTWAY

This application is a Continuation of Application No. PCT/CH01/00554 filed Sep. 14, 2001.

BACKGROUND OF THE INVENTION

The present invention relates to an elevator with a drive unit that is arranged in the elevator shaft laterally at the top and which by means of a drive pulley drives at least one cable, which serves as a support and drive cable and is guided over deflecting rollers of a elevator car and a counterweight, and in that case moves the elevator car and the counterweight in the elevator shaft back and forth, wherein the elevator car when travelling to the uppermost stopping point travels partly past the drive unit.

There is shown in the Japanese patent specification JP 4 50297 an elevator in which the drive unit is arranged in the elevator shaft laterally at the top. The drive unit is, as seen from the shaft door opening, arranged at a side wall of the elevator shaft. At least one cable, which is connected at one end with a support frame of the elevator car and at the other end with a counterweight and which serves as a support and drive cable for the elevator car or the counterweight, is guided by way of a drive pulley, which is arranged transversely to the side wall, of the drive unit. The support frame is constructed as a rucksack frame with an upright frame part guided by means of guide rails and a horizontal base part, on which the elevator car is arranged. On driving to the uppermost stopping point the upper part of the elevator car travels past the drive unit.

There is shown in the German patent specification DE 38 02 386 A1 an elevator installation in which the drive pulley is arranged parallel to the side wall and in which the drive unit is arranged outside the elevator shaft, wherein the drive unit reaches through a recess in the wall to the elevator shaft. The cable guide comprises an underneath looping of the elevator car.

A disadvantage of the above-described known equipment is that with the cable guide requires a drive unit with gears and the cable guide is usable merely for small elevator cars.

SUMMARY OF THE INVENTION

The present invention concerns an elevator installation that includes a drive unit arranged in an associated elevator shaft laterally at the top thereof and having a drive pulley driving at least one cable, which cable serves as a support and drive cable and is guided over deflecting rollers of an elevator car and a counterweight to move the elevator car and the counterweight up and down in the elevator shaft, wherein the elevator car when travelling to the uppermost stopping point travels partly past the drive unit, comprising: a drive cable; a pair of deflecting rollers arranged laterally on an elevator car support frame, the cable being guided over the deflecting rollers; and a gearless drive unit with a drive pulley driving the cable, the drive unit having a drive axis adapted to extend parallel to a first side wall of an elevator shaft with the drive pulley arranged transversely to the first side wall. The drive unit is constructed to be long and slender in a direction of the drive axis and the support frame is a rucksack frame.

The cable has one end attached to a first cable fixing point and extends from said first cable fixing point over the deflecting rollers to the drive pulley and from the drive pulley over another pair of deflecting rollers to a second cable fixing point. The another pair of deflecting rollers can be aligned to direct the cable along a path that is not parallel to the first side wall. The drive unit is mounted on a crossbeam in the elevator shaft and the first and second cable fixing points are on the crossbeam. The elevator installation includes a pair of fixed rollers, each of the fixed rollers engaging the cable between the deflecting rollers of associated ones of the pairs of deflecting rollers, and the fixed rollers are mounted on the crossbeam.

The advantages achieved by the elevator installation according to the present invention are that the shaft cross-section can be utilized in optimum manner. In addition, a machine room is not necessary in the case of the elevator configuration according to the present invention. By contrast to conventional cable guides, with the proposed cable guide the entire cable length can be shortened and a drive unit without gears can be used.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
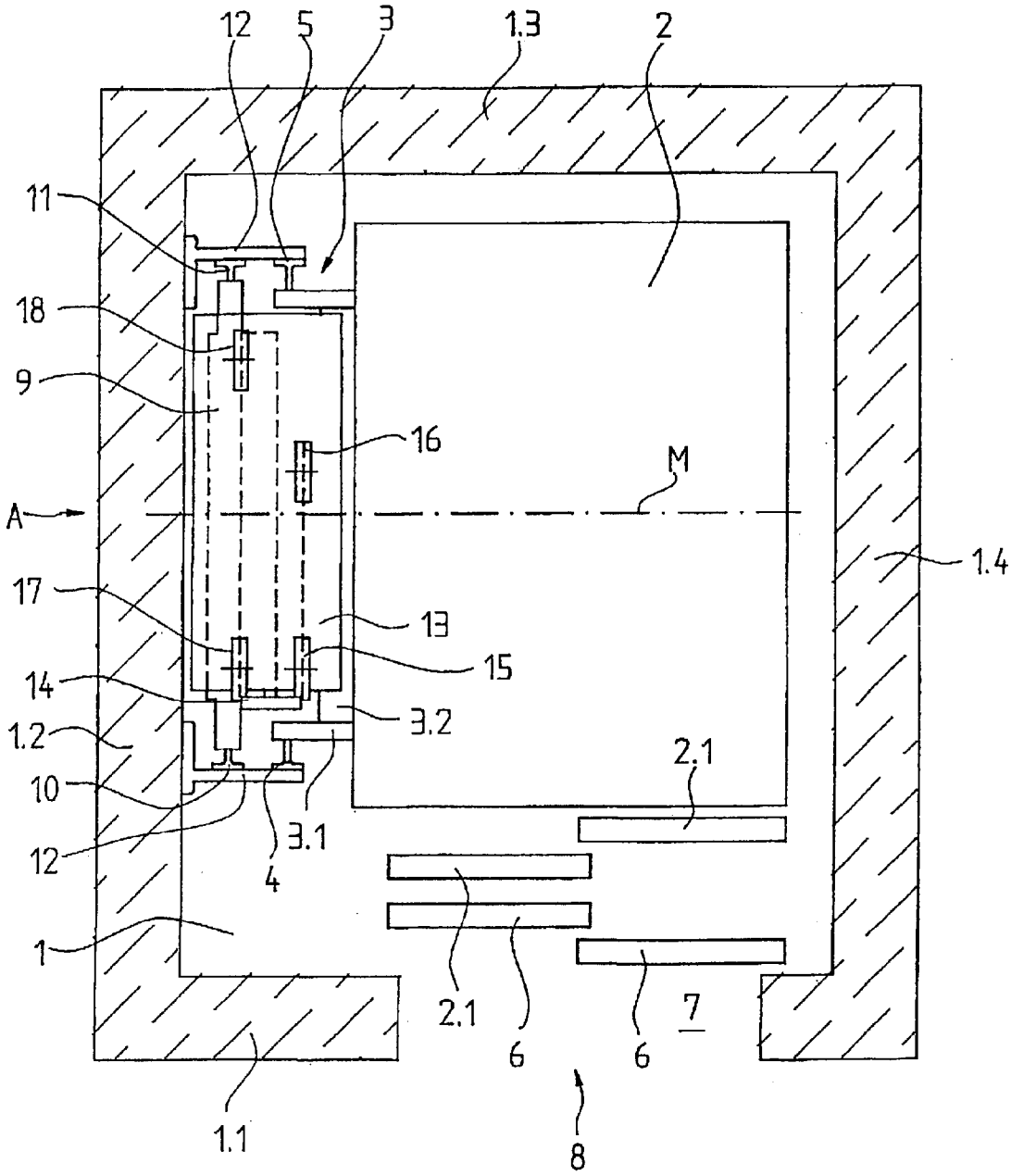
FIG. 1 is a bottom plan schematic view of an elevator installation according to the present invention with a rucksack suspended car and a 2:1 cable path.

FIG. 1 shows a plan view of an elevator installation according to the present invention with an elevator car 2 movable in an elevator shaft 1. The elevator shaft 1 is formed from a front wall 1.1, a first side wall 1.2, a back wall 1.3 and a second side wall 1.4. The elevator car 2 is arranged at a support frame 3, which frame is constructed as a rucksack frame, including an upright frame 3.1 that is guided by means of a first guide rail 4 and a second guide rail 5, and a base frame 3.2 that supports the elevator car 2. The guide shoes or guide rollers, that are connected with the frame 3.1 and slide or roll along the guide rails 4 and 5, are conventional and are not illustrated. Floor doors 6 close an opening 7 in the front wall 1.1, through which opening 7 an interior of the elevator car 2 is accessible from a floor 8, wherein the elevator car 2 is closable by means of car doors 2.1.

A counterweight 9 is guided in the elevator shaft 1 by means of a third guide rail 10 and by means of a fourth guide rail 11. The guide shoes or guide rollers, which are connected with the counterweight 9 and slide or roll along the guide rails 10 and 11, are conventional and are not illustrated. The guide rails 4 and 5 associated with the elevator car 2 and the guide rails 10 and 11 associated with the counterweight 9 are supported on the floor of the shaft pit, wherein the guide rails 4, 5, 10 and 11 are maintained at specific spacings by means of brackets 12 over the shaft height. The guide rails 4, 5, 10 and 11 support a gearless drive unit 13 with a drive pulley 14, by way of which at least one cable 19 (FIG. 2), which serves as a support and drive cable for the elevator car 2 or the counterweight 9, is guided. The cable 19 is guided at the car side by way of a first deflecting roller 15 and a second deflecting roller 16 and is guided at the counterweight side by way of a third deflecting roller 17 and a fourth deflecting roller 18.

The drive unit 13 is arranged with a longitudinal or rotational axis parallel to the first side wall 1.2 and the drive pulley 14 is arranged transversely to the first side wall 1.2. So that the space between the first side wall 1.2 and the elevator car 2 can be utilized in an optimum manner for the guide rails and the drive unit and be kept small, the drive unit 13 must be constructed to be long and slender. The width of the drive unit 13 should not substantially exceed the overhang of the mounting for the guide rails. The drive unit 13 constructed to be slender and long can be, for example, twice as long as its diameter.

The position of the drive pulley 14 determines in the horizontal direction the position of the first deflecting roller 15 and the position of the third deflecting roller 17. So that skewed tensioning cannot arise, the longitudinal axis of the first deflecting roller 15 and the third deflecting roller 17 must intersect the longitudinal axis of the drive pulley 14 at the circumference of the drive pulley 14. Thus, the cable 19 extends vertically between the drive pulley 14 and the deflecting rollers 15 and 17 since the peripheries are aligned.

The second deflecting roller 16 is asymmetrically arranged with respect to a center line M of the car 2, because the weight distribution due to the car doors 2.1 is also asymmetrical. Moreover, the elevator users during travel tend to stand in the front part of the elevator car 2.

Figure 2:
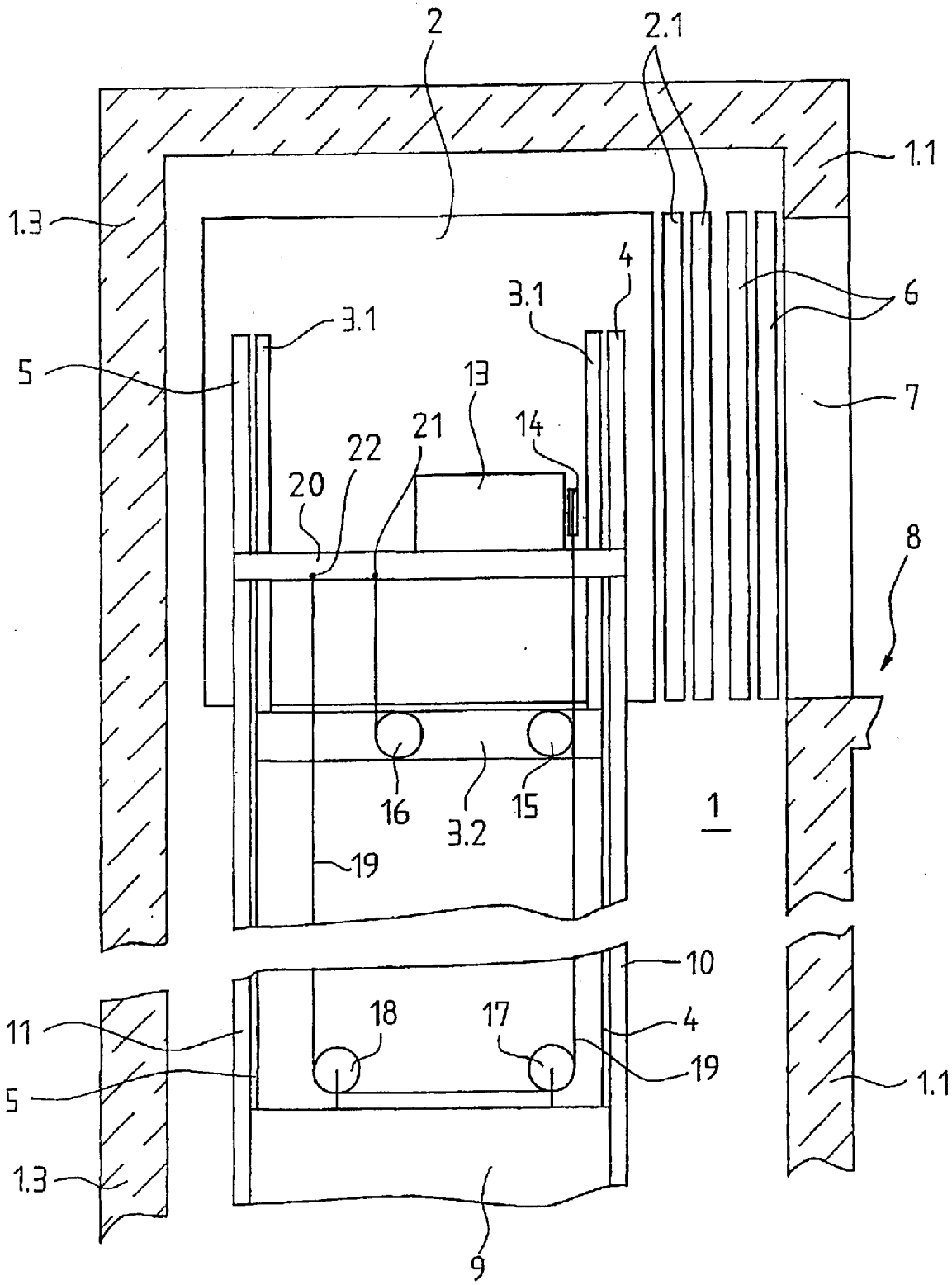
FIG. 2 is a side elevation view of the elevator installation of FIG. 1 seen from a direction "A"

FIG. 2 shows the elevator installation in accordance with the present invention as seen from a direction "A" in FIG. 1. The drive unit 13 is arranged on a crossbeam 20, which crossbeam is supported by the guide rails 4, 5, 10 and 11. A first cable fixing point 21 and a second cable fixing point 22 are also arranged at the crossbeam 20. The cable 19 runs from the first cable fixing point 21 over the second deflecting roller 16, on to the first deflecting roller 15, on over the drive pulley 14 and from this over the third deflecting roller 17 and subsequently over the fourth deflecting roller 18 to the second cable fixing point 22. The cable path does not intersect the car plane projection. A gearing reduction of 2:1 is achieved between the drive unit 13 and the elevator car 2 by the depicted path of the cable 19. For a movement of the elevator car 2 or the counterweight 9 of, for example, one meter, the drive unit 13 must move, by means of the drive pulley 14 two meters of the cable 19. Instead of the first deflecting roller 15 and the second deflecting roller 16, there can be provided only one deflecting roller, which is arranged laterally of the elevator car. Only one deflecting roller can be provided instead of the third deflecting roller 17 and the fourth deflecting roller 18.

With the deflecting rollers 15 and 16 arranged laterally of the elevator car 2 at the support frame 3, the elevator car 2 can, as shown in FIG. 2, travel partly past the drive unit 13. Although the drive unit 13 is disposed substantially lower than the upper edge of the elevator car 2, the uppermost floor 8 can be served.

Figure 3:
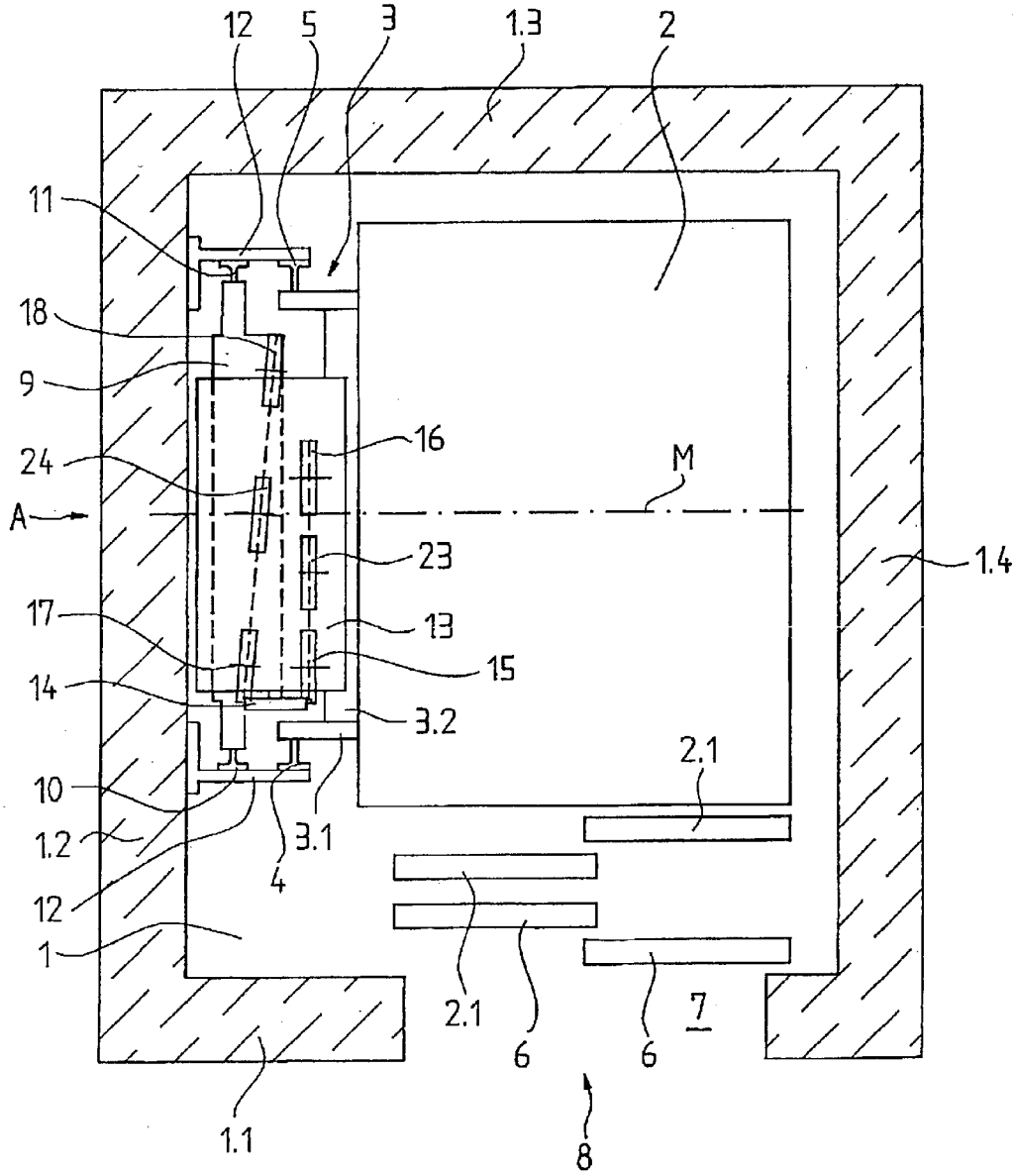
FIG. 3 is a view similar to FIG. 1 with an elevator installation according to the present invention with a rucksack suspended car and a 4:1 cable path.
Figure 4:
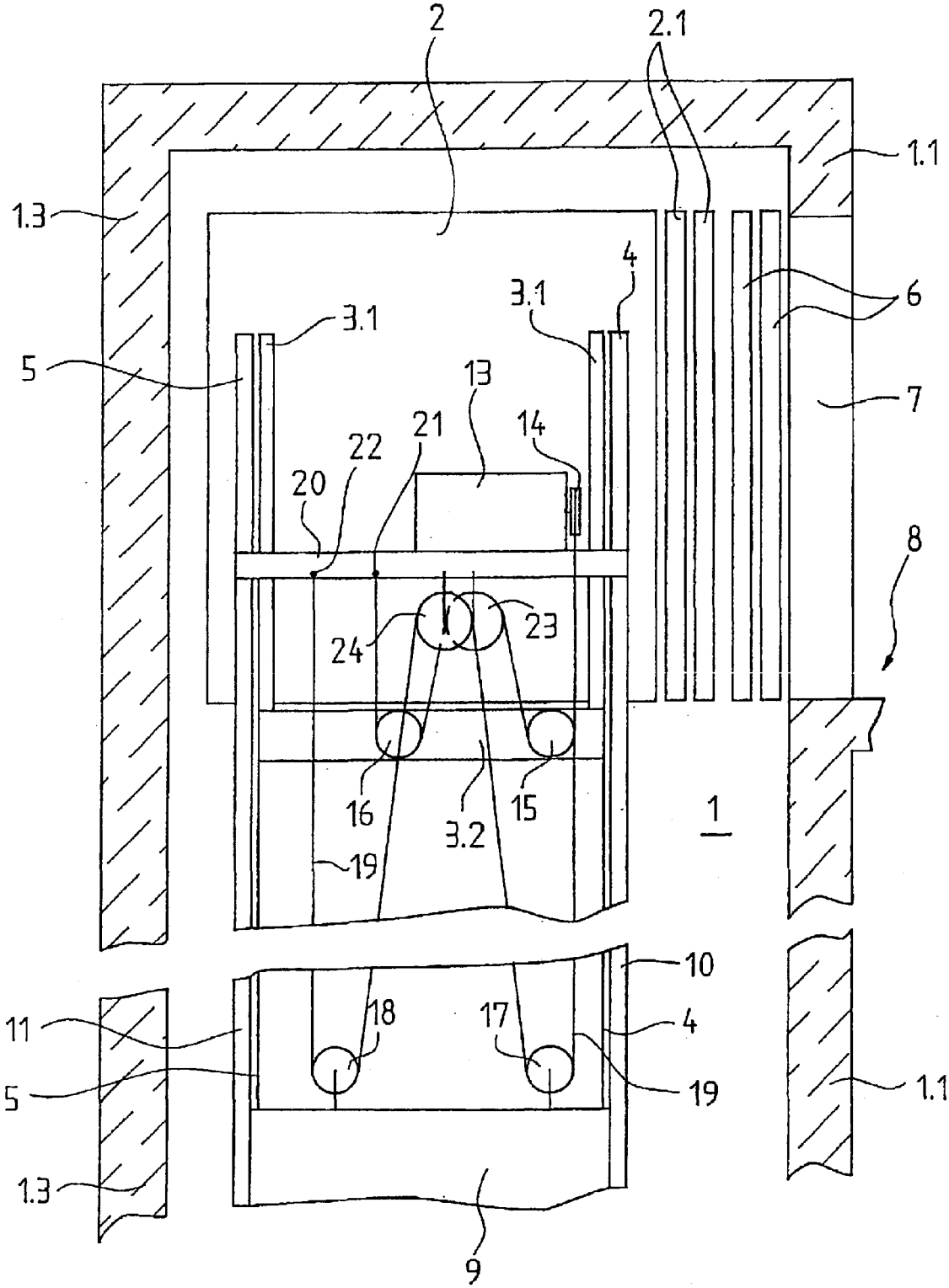
FIG. 4 is a view similar to FIG. 2 of the elevator installation of FIG. 3 seen from the direction "A".

FIGS. 3 and 4 show, in principle, the same elevator installation as do FIGS. 1 and 2 with the difference that the cable path at the car side has been supplemented by a first fixed roller 23 and at the counterweight side by a second fixed roller 24. The first fixed roller 23 is arranged at the crossbeam 20 in the cable path between the first deflecting roller 15 and the second deflecting roller 16. The second fixing roller 24 is arranged at the crossbeam 20 in the cable path between the third deflecting roller 17 and the fourth deflecting roller 18. A gearing reduction of 4:1 is achieved by the depicted path of the cable 19 between the drive unit 13 and the elevator car 2. For a movement of the elevator car 2 or the counterweight 9 of, for example, one meter, the drive unit 13 must move, by means of the drive pulley 14, four meters of the cable 19. A 4:1 cable path is used for larger car loads.

The longitudinal axes of the third deflecting roller 17, the fourth deflecting roller 18 and the second fixing roller 24 lie in the diagonal of the plan projection of the counterweight 9. Thus, the eccentric guidance of the counterweight 9 is taken into account. The guide elements of the counterweight 9 are thereby subjected to less load.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An elevator installation includes a drive unit arranged in an associated elevator shaft laterally at the top thereof and having a drive pulley driving at least one cable, which cable serves as a support and drive cable and is guided over deflecting rollers of an elevator car and a counterweight to move the elevator car and the counterweight up and down in the elevator shaft, wherein the elevator car when travelling to the uppermost stopping point travels pertly past the drive unit, comprising:

a drive cable;

an elevator car support frame being a rucksack frame;

a pair of deflecting rollers arranged laterally on said elevator car support frame, said cable being guided over said deflecting rollers; and a gearless drive unit with a drive pulley driving said cable, said drive unit having a drive axis adapted to extend parallel to a first side wall of an elevator shaft with said drive pulley arranged transversely to the first side wall.

2. The elevator installation according to claim 1 wherein said drive unit is constructed to be long and slender in a direction of said drive axis.

3. The elevator installation according to claim 1 wherein said cable has one end attached to a first cable fixing point and extends from said first cable fixing point over said deflecting rollers to said drive pulley and from said drive pulley over another pair of deflecting rollers to a second cable fixing point.

4. The elevator installation according to claim 3 wherein said another pair of deflecting rollers are aligned to direct said cable along a path that is not parallel to the first side wall.

5. The elevator installation according to claim 3 wherein said drive unit is mounted on a crossbeam in the elevator shaft and said first and second cable fixing points are on said crossbeam.

6. The elevator installation according to claim 3 including a pair of fixed rollers, each of said fixed rollers engaging said cable between said deflecting rollers of associated ones of said pairs of deflecting rollers.

7. The elevator installation according to claim 6 wherein said drive unit is mounted on a crossbeam in the elevator shaft and said fixed rollers are mounted on said crossbeam.

8. An elevator installation including an elevator car and a counterweight movable in an elevator shaft comprising:

a gearless drive unit with a drive pulley, said drive unit having a drive axis and being mounted in a top of the elevator shaft with said drive axis extending parallel to a first aide wall of the elevator shaft with said drive pulley arranged transversely to the first side wall;

a drive cable engaged by said drive pulley;

an elevator car support frame being a rucksack frame;

a first pair of deflecting rollers arranged laterally on said elevator car support frame, said cable extending from a first cable fixing point over said first pair of deflecting rollers to engage said drive pulley; and a second pair of deflecting rollers arranged on the counterweight, said cable extending from said drive pulley over said second pair of deflecting rollers to a second cable fixing point.

9. The elevator installation according to claim 8 wherein said drive unit is constructed to be long mad slender in a direction of said drive axis.

10. The elevator installation according to claim 8 wherein a periphery of said drive pulley is aligned with a periphery of one of said deflecting rollers of each of said first and second pairs of deflecting rollers.

11. The elevator installation according to claim 8 including:

a pair of fixed rollers mounted in the top of the elevator shaft, each of said fixed rollers engaging said cable between said deflecting rollers of associated ones of said first and second pairs of deflecting rollers.

12. The elevator installation according to claim 11 wherein said drive unit is constructed to be long and slender in a direction of said drive axis.

13. The elevator installation according to claim 11 wherein a periphery of said drive pulley is aligned with a periphery of one of said deflecting rollers of each of said first and second pairs of deflecting rollers.

14. The elevator installation according to claim 11 wherein said second pair of deflecting rollers are aligned to direct said cable along a path that is not parallel to the first side wall.

15. An elevator installation including an elevator car and a counterweight movable in an elevator shaft comprising:

a gearless drive unit with a drive pulley, said drive unit having a drive axis and being mounted in a top of the elevator shaft with said drive axis extending parallel to a first side wall of the elevator shaft with said drive pulley arranged transversely to the first side wall;

a drive cable engaged by said drive pulley;

a first pair of deflecting rollers arranged laterally on an elevator car support frame, said cable extending from a first cable fixing point over said first pair of deflecting rollers to engage said drive pulley; and a second pair of deflecting rollers arranged on the counterweight, said cable extending from said drive pulley over said second pair of deflecting rollers to a second cable fixing point, wherein a periphery of said drive pulley is aligned with a periphery of one of said deflecting rollers of each of said first and second pairs of deflecting rollers.

* * * * *